US007382864B2

(12) United States Patent
Hebert et al.

(10) Patent No.: US 7,382,864 B2
(45) Date of Patent: Jun. 3, 2008

(54) SYSTEMS, METHODS AND APPARATUS OF A COMPOSITE X-RAY TARGET

(75) Inventors: Michael Scott Hebert, Muskego, WI (US); Gregory Alan Steinlage, Hartland, WI (US)

(73) Assignee: General Electric Company, Schenectady, NY (US)

( * ) Notice: Subject to any disclaimer, the term of this patent is extended or adjusted under 35 U.S.C. 154(b) by 160 days.

(21) Appl. No.: 11/227,645

(22) Filed: Sep. 15, 2005

(65) Prior Publication Data

US 2007/0071174 A1 Mar. 29, 2007

(51) Int. Cl.
*H01J 35/08* (2006.01)
*H01J 35/10* (2006.01)

(52) U.S. Cl. ..... 378/143; 378/144

(58) Field of Classification Search ..... 378/119, 378/134, 143, 144
See application file for complete search history.

(56) References Cited

U.S. PATENT DOCUMENTS 3,710,170 A 1/1973 Friedel
4,978,051 A 12/1990 Tiearney et al.
5,178,316 A 1/1993 Block
6,421,423 B1 7/2002 Warren
6,430,264 B1 * 8/2002 Lee ..... 378/144
6,463,125 B1 10/2002 Minas et al.
6,584,172 B2 6/2003 Tiearney et al.
6,707,883 B1 3/2004 Tiearney et al.
6,940,946 B2 * 9/2005 Kutschera ..... 378/130
2004/0013234 A1 * 1/2004 Kutschera ..... 378/144

* cited by examiner

*Primary Examiner*—Irakli Kiknadze
(74) *Attorney, Agent, or Firm*—Peter Vogel, Esq.; Michael G. Smit, Esq.

(57) ABSTRACT

Systems, methods and apparatus are provided through which in some embodiments an X-Ray energy target includes composite material that varies spatially in thermal properties, and in some embodiments, the composite material varies spatially in strength properties. In some embodiments, the spatial variance is a continuum and in other embodiments, the spatial variance is a plurality of distinct portions.

20 Claims, 9 Drawing Sheets

600

900

SYSTEMS, METHODS AND APPARATUS OF A COMPOSITE X-RAY TARGET

FIELD OF THE INVENTION

This invention relates generally to electromagnetic energy targets, and more particularly to X-Ray targets.

BACKGROUND OF THE INVENTION

X-Ray imaging systems have an X-Ray target. In conventional X-Ray targets, graphite is brazed to a high temperature capable material. Thermal storage is provided by the graphite.

Large X-Ray targets in computed tomography systems have a limiting mechanical factor in the strength of the graphite material. In computed tomography systems, a gantry rotates at approximately three revolutions per second around a patient and an anode having the X-Ray target rotates at 100 to 200 revolutions per second. The rotation creates large centripetal forces on the X-Ray target that increases exponentially as the size of the X-Ray target increases.

X-Ray targets in X-Ray imaging systems also have a limiting mechanical factor in the thermal conductivity of the graphite material. The X-Ray target must be able to conduct heat at a specified minimum in order to be able to emit X-Ray energy at a certain minimum rate. The rate of emitted X-Ray energy limits the rate of X-Ray images that can be made by the X-Ray imaging systems, and limits the usefulness of the conventional X-Ray imaging systems.

In order to satisfy the need for larger X-Ray targets in X-Ray imaging systems, the strength of the graphite needs to be improved. However, in order to create a graphite material with higher strength, the thermal conductivity properties of the material are adversely affected in X-Ray targets because higher strength graphite typically has lower thermal conductivity.

For the reasons stated above, and for other reasons stated below which will become apparent to those skilled in the art upon reading and understanding the present specification, there is a need in the art for an X-Ray target that has increased mechanical strength without decreased thermal conductivity.

BRIEF DESCRIPTION OF THE INVENTION

The above-mentioned shortcomings, disadvantages and problems are addressed herein, which will be understood by reading and studying the following specification.

In one aspect, systems, methods and apparatus are provided through which an X-Ray energy target includes composite material.

In another aspect, the composite material varies spatially in thermal properties. In yet another aspect, the composite material varies spatially in strength properties.

In still another aspect, the spatial variance is a continuum or graded in which either or both the thermal property and the strength property varies gradually or in very slight stages without any clear dividing point.

In a further aspect, the spatial variance is a plurality of distinct portions.

The variation in strength and thermal conductive properties throughout the X-Ray target provides an X-Ray target that has increased mechanical strength without decreased thermal conductivity.

Apparatus, systems, and methods of varying scope are described herein. In addition to the aspects and advantages described in this summary, further aspects and advantages will become apparent by reference to the drawings and by reading the detailed description that follows.

DETAILED DESCRIPTION OF THE INVENTION

In the following detailed description, reference is made to the accompanying drawings that form a part hereof, and in which is shown by way of illustration specific embodiments which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

The detailed description is divided into four sections. In the first section, a system level overview is described. In the second section, apparatus of embodiments are described. In the third section, embodiments of methods are described. Finally, in the fourth section, a conclusion of the detailed description is provided.

System Level Overview

Figure 1:
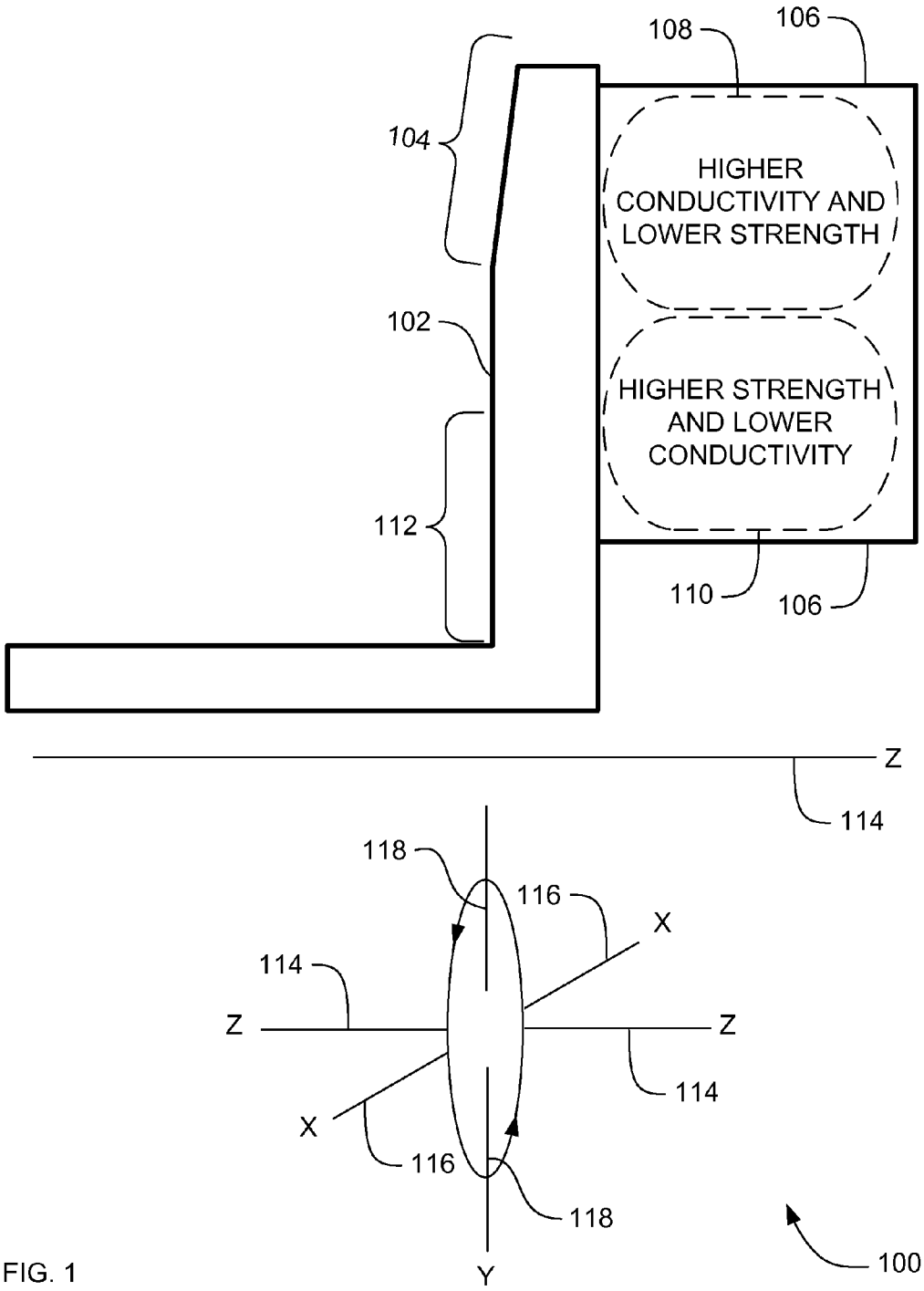
FIG. 1 is a cross section block diagram of an overview of a composite X-Ray target.

FIG. 1 is a cross section block diagram of an overview of a composite X-Ray target. System 100 is often referred to as an X-Ray target. System 100 solves the need in the art for an X-Ray target that has increased mechanical strength without decreased thermal conductivity.

System 100 includes an X-Ray target cap 102 having a focal track 104 in the vicinity of an outer diameter of the X-Ray target cap 102. The X-Ray target cap 102 is manufactured of conventional materials, such as a refractory metal. Examples of refractory metals are molybdenum, molybdenum alloys, tungsten and tungsten alloys.

System 100 also includes an X-Ray target 106. The X-Ray target includes composite graphite material. The composite graphite target 106 has a region 108 of higher conductive properties and a region 110 of higher strength properties.

The composite graphite target 106 is non-uniform. The composite graphite material varies in the strength and thermal conductive properties throughout the X-Ray target 106. In some embodiments the region 108 of higher conductive properties has a thermal conductivity of 128 W/m K and a strength of 49 MPa or a thermal conductivity of 120 W/M k and a strength of 55 MPa. In some embodiments, the region 110 of higher strength properties has a strength of 49 MPa and a thermal conductivity of 70 W/M k.

In various embodiments, the composite X-Ray target 106 is compound, complex, merged, fused, amalgamated, combined, multiple, multipart, mixed and/or synthesized. The variation in strength and thermal conductive properties throughout the composite X-Ray target 106 provides an X-Ray target 106 that has increased mechanical strength without decreased thermal conductivity.

The composite graphite target 106 has higher mechanical loading capability while still meeting thermal requirements of conduction and storage of heat generated during X-Ray production. Likewise, the composite graphite target 106 has higher mechanical capabilities and provides for potentially higher speeds and higher safety margins for a rotating anode.

System 100 rotates about a longitudinal Z-axis 114 through a plane (not labeled) formed by an X-axis 116 and a Y axis 118.

Figure 3:
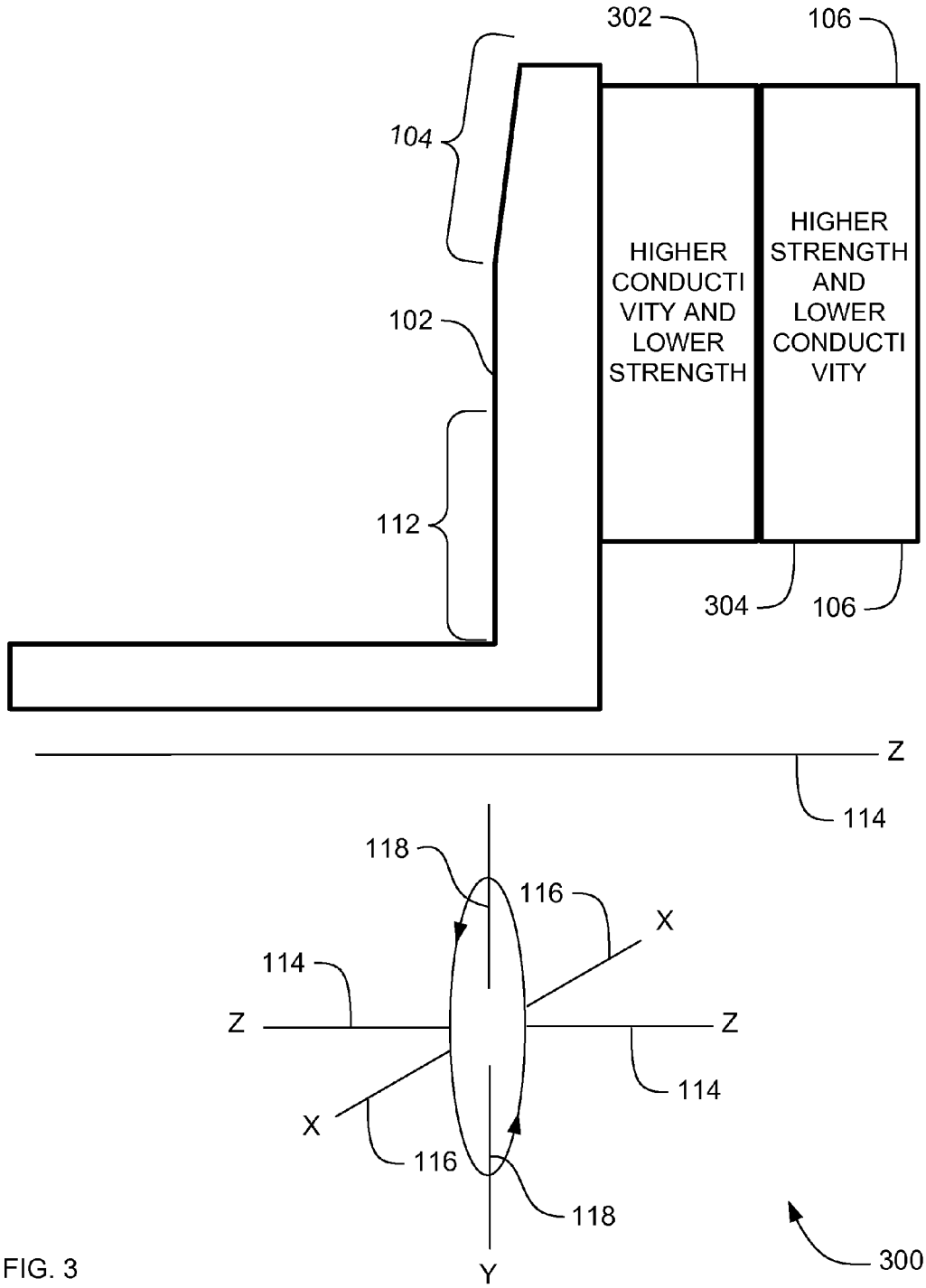
FIG. 3 is a cross section block diagram of an X-Ray target according to an embodiment having multiple portions of graphite positioned axially.
Figure 5:
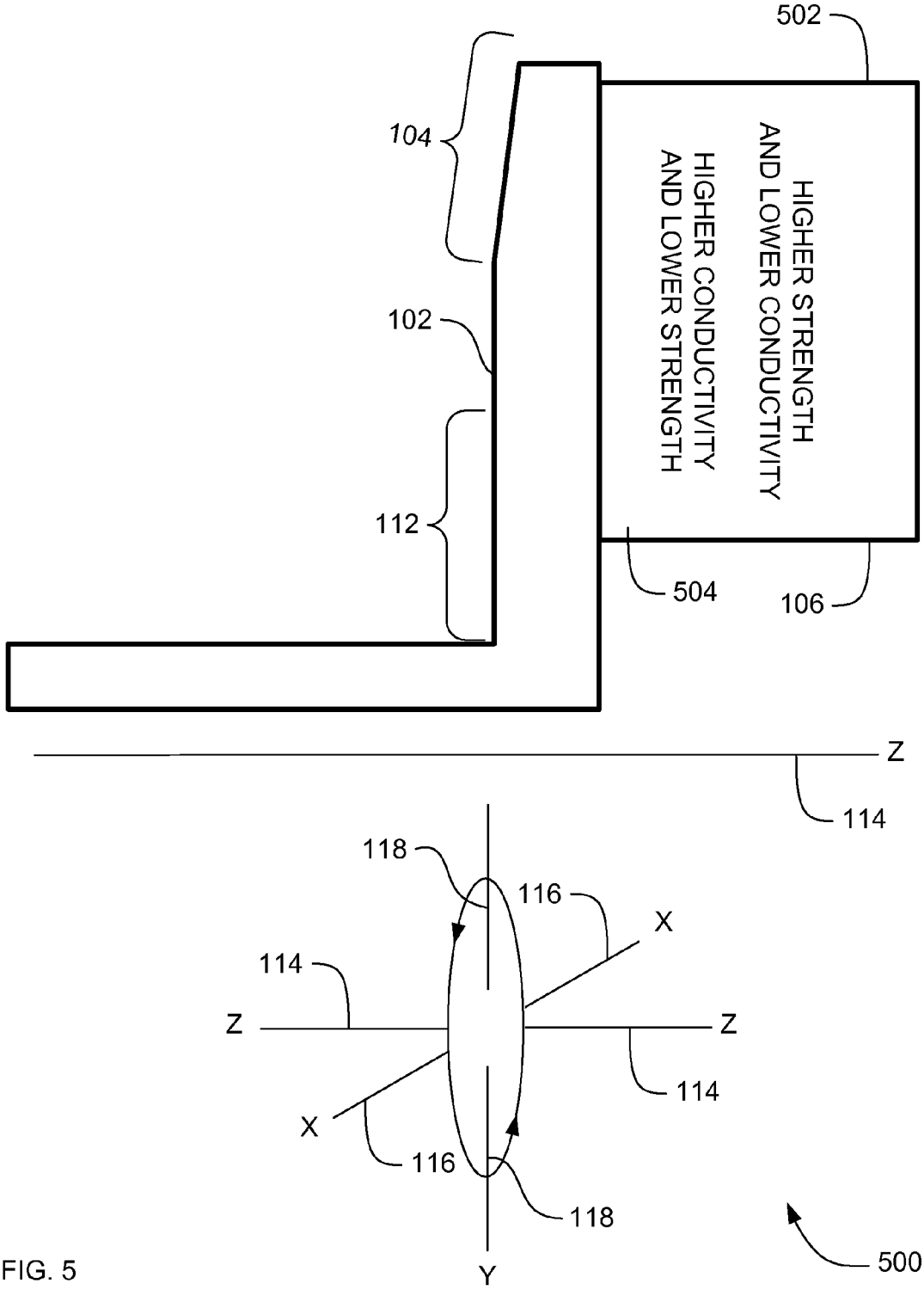
FIG. 5 is a cross section block diagram of an X-Ray target according to an embodiment having axially graded portions of graphite.

While system 100 shows the region 108 of higher conductive properties in the vicinity of the focal track 104 and system 100 shows the region 110 of higher strength properties in the vicinity of an inner diameter 112, system 100 is not limited to those particular spatial relationships. In particular, the apparatus in FIG. 3 and FIG. 5 show other spatial relationships between the region 108 of higher conductive properties, the focal track 104, the region 110 of higher strength properties and the inner diameter 112.

While the system 100 is not limited to any particular X-Ray target cap 102, focal track 104, composite graphite target 106, higher conductivity region 108, higher strength region 110, and inner diameter 112, for sake of clarity a simplified X-Ray target cap 102, focal track 104, composite graphite target 106, higher conductivity region 108, higher strength region 110, and inner diameter 112 are described. The inner diameter is closer to the axis of rotation, the longitudinal Z axis, than the focal track 104.

System 100 is useful in general X-Ray applications, and all other X-Ray applications including vascular X-Ray systems, mammography X-Ray systems, orthopedic X-Ray systems and baggage scanner X-Ray systems.

Apparatus Embodiments

In the previous section, a system level overview of the operation of an embodiment was described. In this section, the particular apparatus of such an embodiment are described by reference to a series of diagrams.

Figure 2:
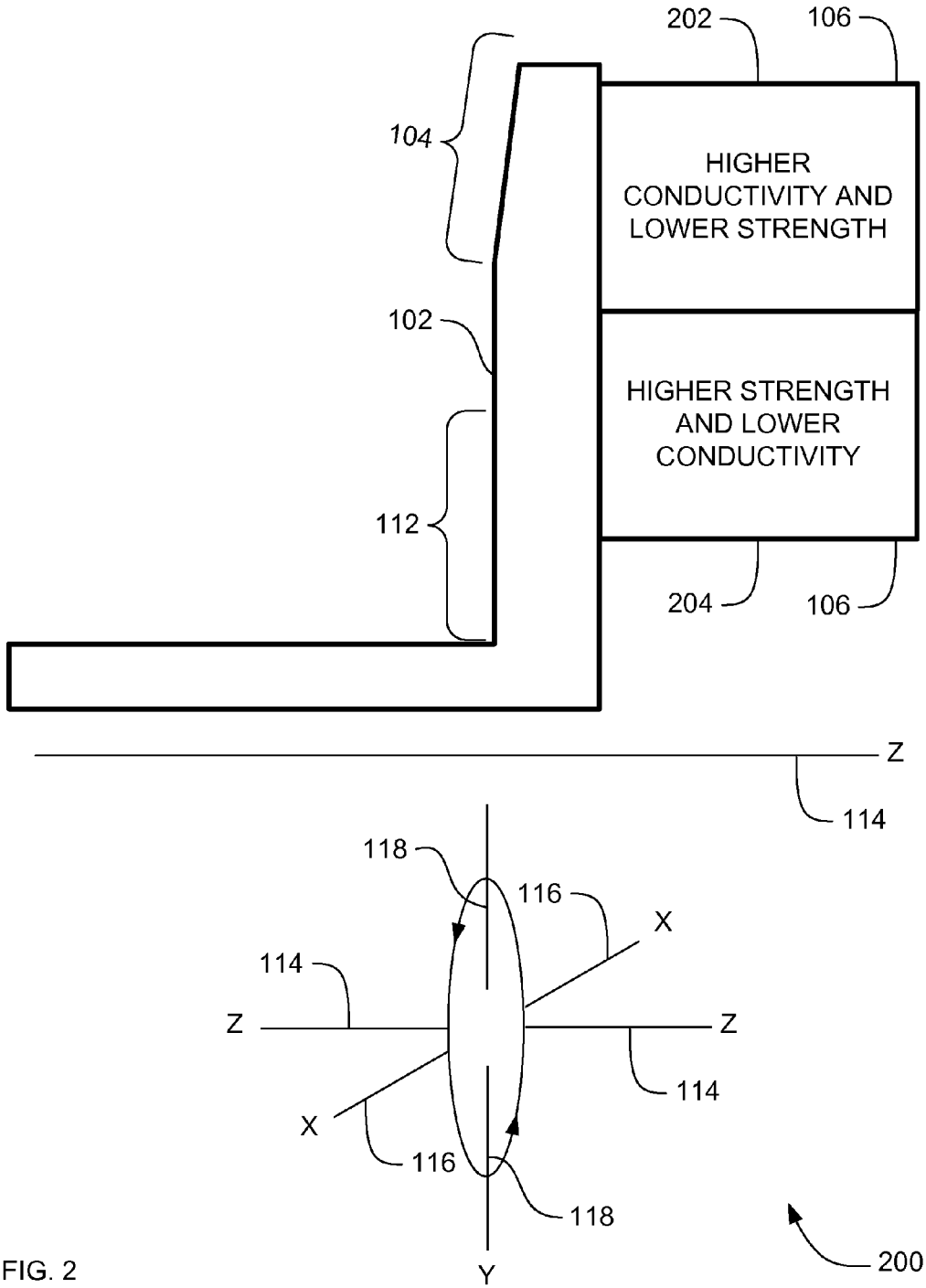
FIG. 2 is a cross section block diagram of an X-Ray target according to an embodiment having a plurality of portions of graphite that are positioned radially.

FIG. 2 is a cross section block diagram of an X-Ray target 200 according to an embodiment having a plurality of portions of graphite that are positioned radially. Apparatus 200 solves the need in the art for an X-Ray target that has increased mechanical strength without decreased thermal conductivity.

The composite graphite target 106 has a plurality of regions that are composed of different graphite material. In the embodiment shown in FIG. 2, a region 202 is composed of a different graphite material than a graphite material of a region 204.

In some embodiments, the composite graphite target 106 has a region 202 of higher conductive properties and lower strength properties in the vicinity of the focal track 104. In some embodiments, the composite graphite target 106 also has a region 204 of higher strength properties and lower conductive properties in the vicinity of the inner diameter 112.

The higher conductive properties and lower strength properties of region 202 are relative to the higher strength properties and lower conductive properties of region 204. More specifically, the second region 204 has a heat conductive property that conducts heat less than the heat conductive property of the first region 202 and the second region 204 has a strength property that is greater than the strength property of the first region 202.

In addition, the region 202 and region 204 are positioned relative to each other along a radial direction, the Y axis. The region 202 having the higher heat conductive properties and the lower strength properties is positioned further away from the longitudinal Z axis of rotation than the region 204 having relatively lower heat conductive properties and relatively higher strength properties.

The variation in strength and thermal conductive properties in the composite X-Ray target 106 provides an X-Ray target 106 that has increased mechanical strength without decreased thermal conductivity. The composite graphite target 106 has higher mechanical loading capability while still meeting thermal requirements of conduction and storage of heat generated during X-Ray production. Likewise, the composite graphite target 106 has higher mechanical capabilities and provides for potentially higher speeds and higher safety margins of a rotating anode.

In some embodiments of apparatus 200, region 202 and region 204 are brazed to the X-Ray target cap 102. In some embodiments, 202 and region 204 are brazed to each other. In FIG. 2, the plurality of portions of graphite shown is two portions of graphite. In some embodiments not shown the plurality of portions of graphite is more than two, such as three. In some embodiments of three portions of graphite, the middle portion has a strength of 85 MPa and a thermal conductivity of 100 W/M k FIG. 3 is a cross section block diagram of an X-Ray target 300 according to an embodiment having multiple portions of graphite positioned axially. Apparatus 300 solves the need in the art for an X-Ray target that has increased mechanical strength without decreased thermal conductivity.

The composite graphite target 106 has a plurality of regions that are composed of different graphite material. In the embodiment shown in FIG. 3, a region 302 is composed of a different graphite material than a graphite material of a region 304.

In some embodiments, the composite graphite target 106 has a region 302 of higher conductive properties and lower strength properties in the vicinity of the X-Ray target cap 102. In some embodiments, the composite graphite target 106 also has a region 304 of higher strength properties and lower conductive properties in the vicinity furthest away from the X-Ray target cap 102.

The higher conductive properties and lower strength properties of region 302 are relative to the higher strength properties and lower conductive properties of region 304. More specifically, the second region 304 has a heat conductive property that conducts heat less than the heat conductive property of the first region 302 and the second region 304 has a strength property that is greater than the strength property of the first region 302.

In addition, the region 302 and region 304 are positioned relative to each other along the longitudinal axis Z axis. The region 302 having the higher heat conductive properties and the lower strength properties is positioned closer to the X-Ray target cap 102 than the region 304 having lower heat conductive properties and higher strength properties.

The variation in strength and thermal conductive properties in the composite X-Ray target 106 provides an X-Ray target 106 that has increased mechanical strength without decreased thermal conductivity. The composite graphite target 106 has higher mechanical loading capability while still meeting thermal requirements of conduction and storage of heat generated during X-Ray production. Likewise, the composite graphite target 106 has higher mechanical capabilities and provides for potentially higher speeds and higher safety margins of a rotating anode.

In some embodiments of apparatus 300, region 302 is brazed to the X-Ray target cap 102. In some embodiments, region 304 is brazed to region 302. In some embodiments the position of 302 and 304 are reversed relative to each other. More specifically the region 304 of higher strength properties and lower conductive properties is positioned in the vicinity of the X-Ray target cap 102 and the region 302 of higher conductive properties and lower strength properties is positioned in the vicinity furthest away from the X-Ray target cap 102.

Figure 4:
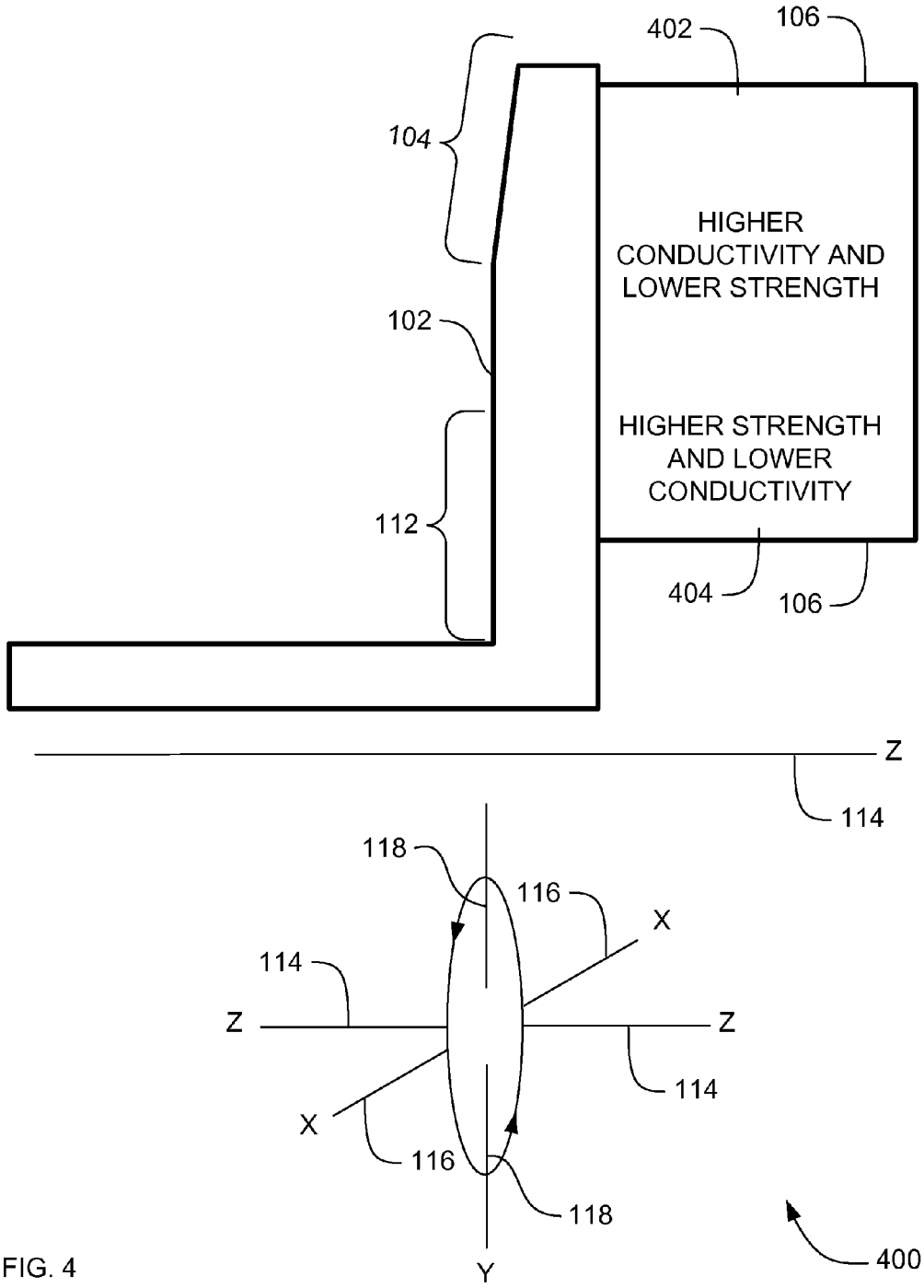
FIG. 4 is a cross section block diagram of an X-Ray target according to an embodiment having radially graded portions of graphite.

FIG. 4 is a cross section block diagram of an X-Ray target 400 according to an embodiment having radially graded portions of graphite. Apparatus 400 solves the need in the art for an X-Ray target that has increased mechanical strength without decreased thermal conductivity.

The composite graphite target 106 is functionally graded to have varying thermal and varying strength characteristics. In the embodiment shown in FIG. 4, the composite graphite material is graded to have higher thermal conductive characteristics and lower strength characteristics at the radial end 402 located closer to the focal track 104.

In some embodiments, the composite graphite target 106 has a region 402 of higher conductive properties and lower strength properties in the vicinity of the focal track 104. In some embodiments, the composite graphite target 106 also has a region 404 of higher strength properties and lower conductive properties in the vicinity of the inner diameter 112. Variation on the thermal and strength properties of the composite graphite target 106 is a continuum or graded in which either or both the thermal property and the strength property varies gradually or in very slight stages without any clear dividing point or boundary.

The higher conductive properties and lower strength properties of region 402 are relative to the higher strength properties and lower conductive properties of region 404. More specifically, the second region 404 has a heat conductive property that conducts heat less than the heat conductive property of the first region 402 and the second region 404 has a strength property that is greater than the strength property of the first region 402.

In addition, the region 402 and region 404 are positioned relative to each other along a radial direction, the Y axis. The region 402 having the higher heat conductive properties and the lower strength properties is positioned further away from the longitudinal Z axis of rotation that the region 404 having relatively lower heat conductive properties and relatively higher strength properties.

The variation in strength and thermal conductive properties in the composite X-Ray target 106 provides an X-Ray target 106 that has increased mechanical strength without decreased thermal conductivity. The composite graphite target 106 has higher mechanical loading capability while still meeting thermal requirements of conduction and storage of heat generated during X-Ray production. Likewise, the composite graphite target 106 has higher mechanical capabilities and provides for potentially higher speeds and higher safety margins of a rotating anode.

FIG. 5 is a cross section block diagram of an X-Ray target 500 according to an embodiment having axially graded portions of graphite. Apparatus 500 solves the need in the art for an X-Ray target that has increased mechanical strength without decreased thermal conductivity.

The composite graphite target 106 is functionally graded to have varying thermal and varying strength characteristics. In the embodiment shown in FIG. 5, the composite graphite material is graded to have higher thermal conductive characteristics and lower strength characteristics at the end 502 located closer to the focal track 104.

In some embodiments, the composite graphite target 106 has a region 502 of higher conductive properties and lower strength properties in the vicinity of the X-Ray target cap 102. In some embodiments, the composite graphite target 106 also has a region 504 of higher strength properties and lower conductive properties in the vicinity furthest away from the X-Ray target cap 102. Variation on the thermal and strength properties of the composite graphite target 106 is a continuum or graded in which either or both the thermal property and the strength property varies gradually or in very slight stages without any clear dividing point.

The higher conductive properties and lower strength properties of region 502 are relative to the higher strength properties and lower conductive properties of region 504. More specifically, the second region 504 has a heat conductive property that conducts heat less than the heat conductive property of the first region 502 and the second region 504 has a strength property that is greater than the strength property of the first region 502.

In addition, the region 502 and region 504 are positioned relative to each other along the longitudinal axis, the Z axis. The region 502 having the higher heat conductive properties and the lower strength properties is positioned closer to the X-Ray target cap 102 than the region 504 having relatively lower heat conductive properties and relatively higher strength properties.

The variation in strength and thermal conductive properties in the composite X-Ray target 106 provides an X-Ray target 106 that has increased mechanical strength without decreased thermal conductivity. The composite graphite target 106 has higher mechanical loading capability while still meeting thermal requirements of conduction and storage of heat generated during X-Ray production. Likewise, the composite graphite target 106 has higher mechanical capabilities and provides for potentially higher speeds and higher safety margins of a rotating anode.

In some embodiments, the grading is in the opposite direction along the longitudinal Z axis. More specifically, the region 502 of higher strength properties and lower conductive properties is positioned in the vicinity of the X-Ray target cap 102 and the region 504 of higher conductive properties and lower strength properties is positioned in the vicinity furthest away from the X-Ray target cap 102.

Figure 6:
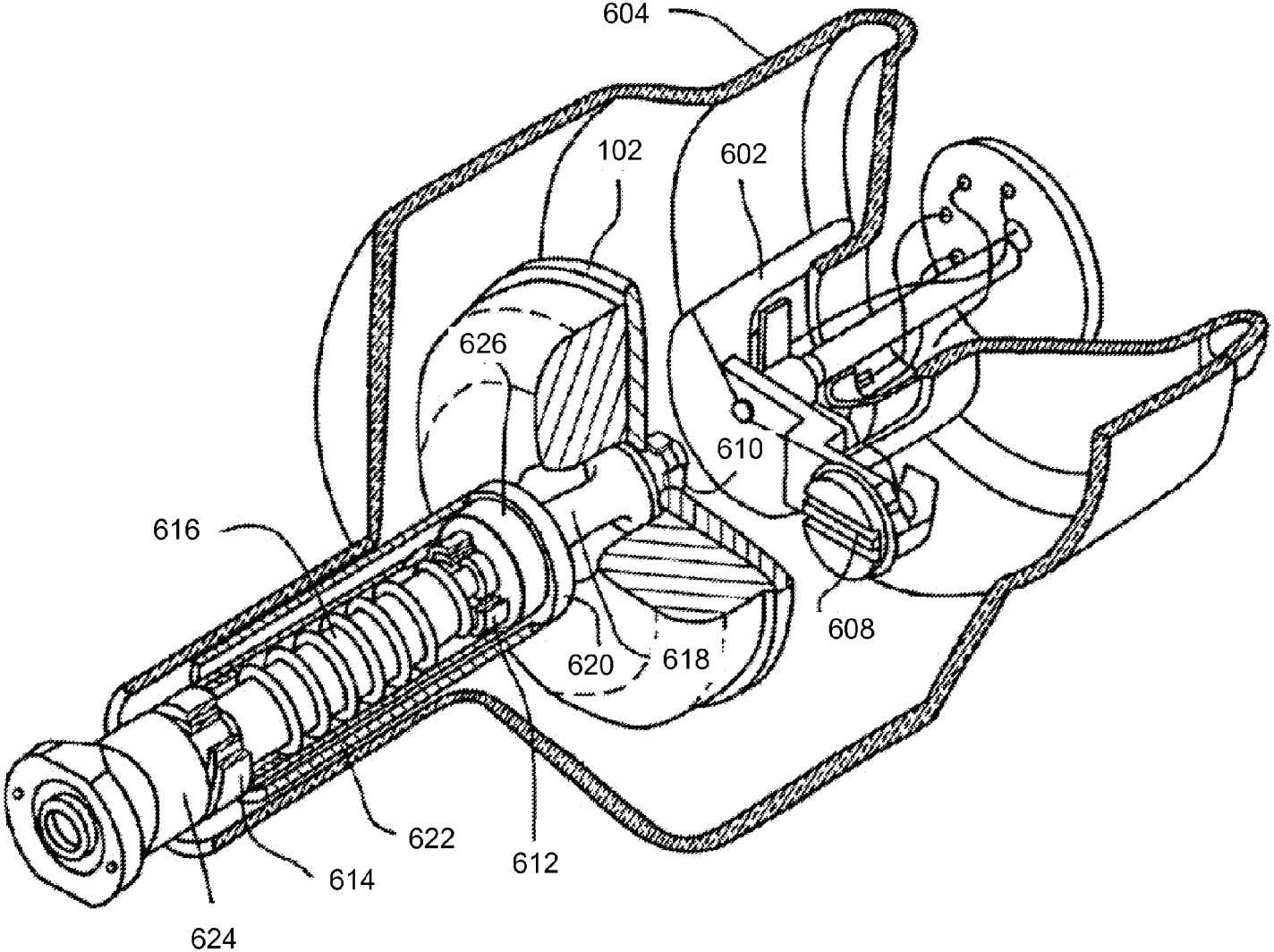
FIG. 6 is a partial perspective view of a representative X-Ray tube with parts removed, parts in section, and parts broken away according to an embodiment having a composite X-Ray target.

FIG. 6 is a partial perspective view of a representative X-Ray tube 600 with parts removed, parts in section, and parts broken away according to an embodiment having a composite X-Ray target.

X-Ray tube 600 solves the need in the art for an X-Ray target that has increased mechanical strength without decreased thermal conductivity.

X-Ray tube 600 includes a cathode 602 positioned inside a glass or metal envelope 604. As is well known, inside the glass or metal envelope there is a vacuum of about 10.sup.−5 to about 10.sup.−9 torr. Electrons are generated at the cathode filament 606 and aimed at the target 106 attached to the X-Ray target cap 102. The target is conventionally connected to a rotating shaft 608 at one end by a Belleville nut 610. A front bearing 612 and a rear bearing 614 are operatively positioned on the shaft 608 and are held in position in a conventional manner. The bearings 612 and 614 are usually solid-film lubricated and therefore have a limited operational temperature range.

A preloaded spring 616 is positioned about the shaft 608 between the bearings 612, 614 for maintaining load on the bearings during expansion and contraction of the anode assembly. A target stud 618 is utilized to connect the target 106 to the bearing shaft 608 and rotor hub 620. The rotor hub 620 interconnects the target 106 and rotor 622. The rotor 622 drives the rotation of the anode assembly. The bearings, both front 612 and rear 614, are held in place by bearing retainers 624 and 626.

The temperature in the area of the filament 606 can get as high as about 2500.degree. C. Other temperatures include about 1100.degree. C. near the center of the rotating target 106, which rotates at about 10,000 rpm. Temperatures of the focal spot on the target 106 can approximate 2500.degree. C. and temperatures on the outside edge of the rotating target 106 approach about 1300.degree. C. The temperature in the area of the rotor hub 620 approaches 700.degree. C. and of the front bearing approaches 450.degree. C. maximum. Obviously, as one moves from the target 106 to the rotor 622 a stator, the temperature decreases.

During operation of some X-Ray systems having larger diameter targets, severe protocol users have maximized usage of the system by making as many scans at high peak power in as short a time as possible. One of the problems with utilizing any X-Ray system in this continuous type of operation is the amount of heat that is generated, which may in fact destroy the bearings 612, 614, especially the front bearing 612.

If the X-Ray tube target 106 and rotor 622 were allowed to continue to rotate at 10,000 rpm between scans, the bearings would wear out prematurely and cause the tube to fail. Thus, if it appears that there would to be more than some specific time delay between scans, the X-Ray system operating control system software is programmed to brake the rotor by rapidly slowing it completely down to zero (0) rpm. However, when ready to initiate a scan, the control system software is programmed to return the target and the rotor to 10,000 rpm as quickly as possible. These rapid accelerations and brakes are utilized because, among other reasons, there are a number of resonant frequencies that must be avoided during the acceleration from zero (0) to 10,000 rpm and the brake from 10,000 rpm to zero (0) rpm. In order to pass through these resonant frequencies both immediately before a scan or a series of scans and after a scan or series of scans as fast as possible, the X-Ray system applies maximum power to bring the target, or anode assembly, to 10,000 rpm or down to zero (0) rpm in the least amount of time possible.

It should be noted that the X-Ray tube target and rotor can be accelerated to 10,000 rpm from a dead stop in about 12 to about 15 seconds and slowed down at about the same rate. Vibration from the resonant frequencies is a problem if the tube is allowed to spin to a stop without braking. This vibration is also a problem if the anode of the tube exhibits poor balance retention.

It has been found that during these rapid accelerations to 10,000 rpm and the immediate braking from 10,000 rpm to zero, stresses, mechanical as well as thermal, impact on the rotor 622, target and bearing connections. These stresses may contribute to anode assembly imbalance which is believed to be the leading cause of recent X-Ray tube failures.

Method Embodiments

In the previous section, apparatus of the manufacture and operation of embodiments were described. In this section, the particular methods of manufacturing the X-Ray energy targets are described by reference to a series of flowcharts. Other methods of manufacturing the X-Ray energy targets beyond the two described below are possible.

Figure 7:
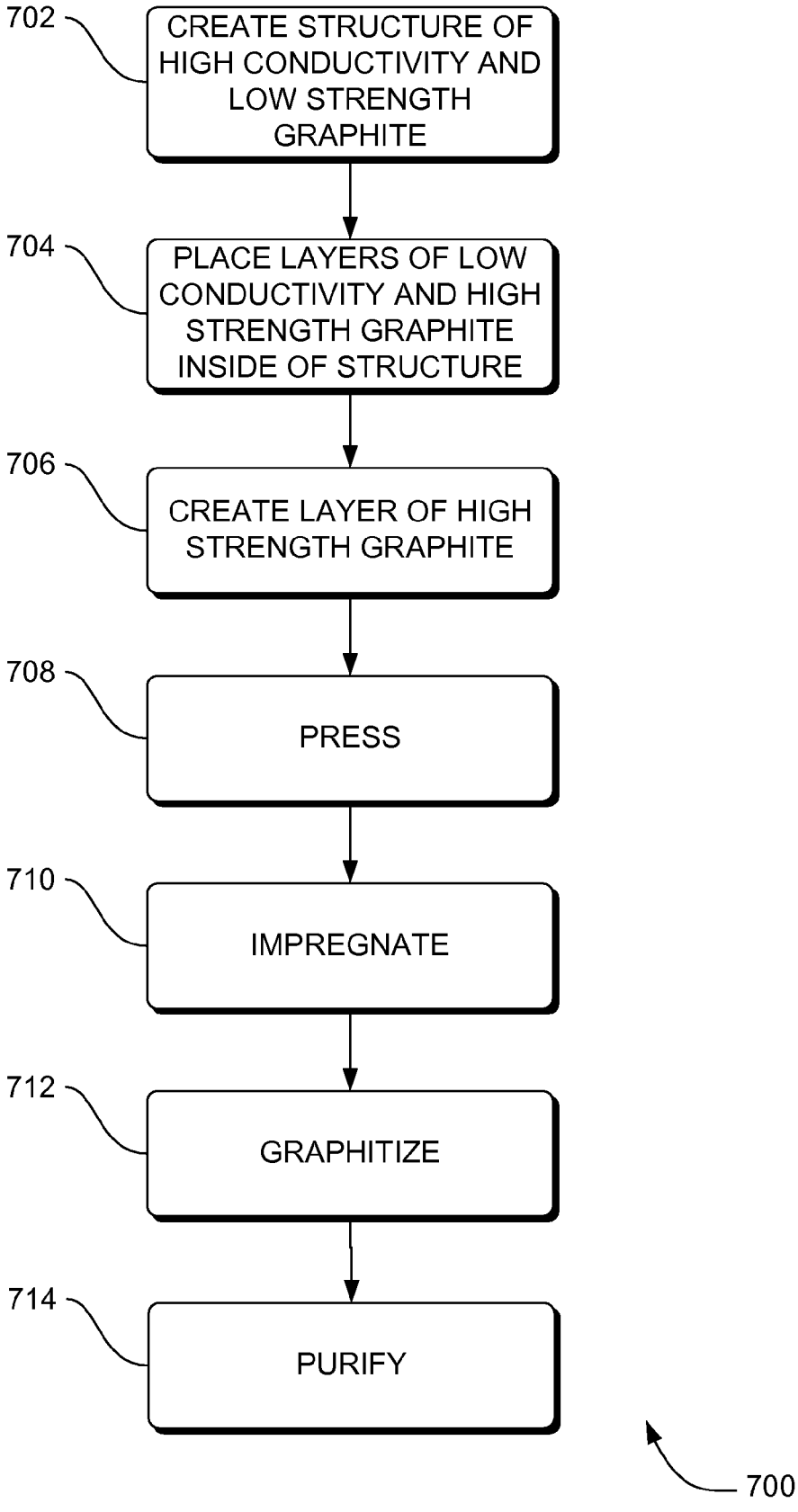
FIG. 7 is a flowchart of a method to grade graphite according to an embodiment.

FIG. 7 is a flowchart of a method 700 to grade graphite according to an embodiment. Method 700 solves the need in the art for an X-Ray target that has increased mechanical strength without decreased thermal conductivity.

Method 700 involves dry layering constituent graphite components. The method 700 includes creating 702 a tubular or solid structure of high conductivity and low strength (e.g. large grain) graphite precursors that defines an outer perimeter of an X-Ray target, such as X-Ray target 106. Thereafter, method 700 includes placing 704 layers of graphite precursors inside the tubular structure, starting with placing high conductivity and low strength graphite (e.g. larger grains).

Subsequently, method 700 includes creating 706 a layer of tubular or solid cylinder of highest strength and lowest thermal conductivity graphite precursors (e.g. smallest grains). Thereafter, method 700 includes pressing 708 for an X-Ray target, impregnating the composite graphite, graphitizing 712 for an X-Ray target and purifying 714 for an X-Ray target into a final graphite form.

Alternatively method 700 is performed by working from the inside to the outside by performing actions of method 700 in the following order: creating 706 a layer of tubular or solid cylinder of highest strength graphite precursors (e.g. smallest grains), placing 704 layers of graphite precursors outside tubular structure, starting with placing high strength graphite material (e.g. finer grains) and ending with placing high thermal conductivity material (e.g. larger grains), then creating 702 a tubular structure of high conductivity (e.g. large grain) graphite precursors that defines an outer perimeter of an X-Ray target, such as X-Ray target 106, and thereafter pressing 708, graphitizing 710 and purifying 712 into a final graphite form.

Figure 8:
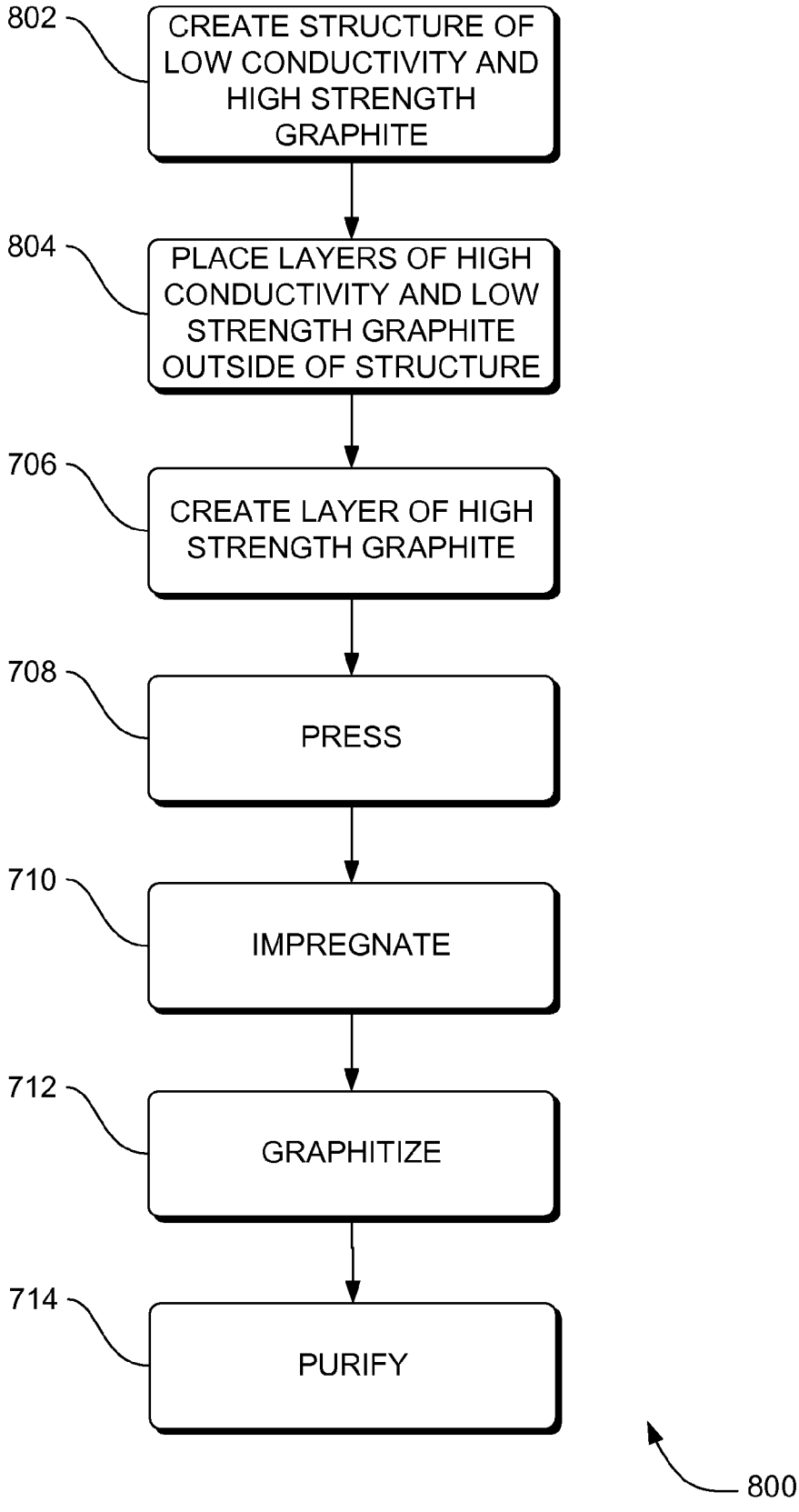
FIG. 8 is a flowchart of a method to grade graphite according to an embodiment.

FIG. 8 is a flowchart of a method 800 to grade graphite according to an embodiment. Method 800 solves the need in the art for an X-Ray target that has increased mechanical strength without decreased thermal conductivity.

Method 800 involves dry layering constituent graphite components. The method 800 includes creating 802 a tubular or solid structure of low conductivity and high strength (e.g. large grain) graphite precursors that defines an outer perimeter of an X-Ray target, such as X-Ray target 106. Thereafter, method 800 includes placing 804 layers of graphite precursors outside the tubular structure, starting with placing low conductivity and high strength graphite (e.g. larger grains).

Figure 9:
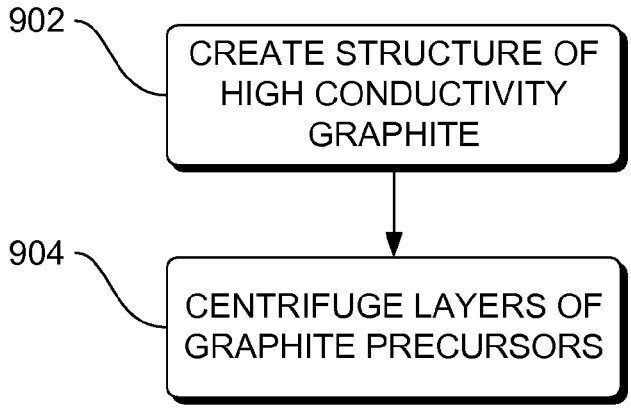
FIG. 9 is a flowchart of a method to grade graphite according to an embodiment.

FIG. 9 is a flowchart of a method 900 to grade graphite according to an embodiment. Method 900 solves the need in the art for an X-Ray target that has increased mechanical strength without decreased thermal conductivity.

The method 900 includes creating 902 a tubular structure of high conductivity (e.g. large grain) graphite precursors that defines an outer perimeter of an X-Ray target, such as X-Ray target 106.

Thereafter, method 900 includes centrifuging layers 904 graphite precursors. The layering 904 is performed either wet or dry by centrifugally maintaining the graphite precursors against the tubular structure.

In one embodiment of layering 904, the layering is centrifugal casting in fluid, taking advantage of Stoke's Law to grade the precursors continually from the inner diameter to the outer diameter. Stoke's law is expressed as an equation relating the terminal settling velocity of a smooth, rigid sphere in a viscous fluid of known density and viscosity to the diameter of the sphere when subjected to a known force field. The equation is $V=(2gr^2)(d1-d2)/9\ \mu$; where:

V=velocity of fall (cm $sec^{-1}$), g=acceleration of gravity (cm $sec^{-2}$), r="equivalent" radius of particle (cm), d1=density of particle (g $cm^{-3}$), d2=density of medium (g $cm^{-3}$), and μ=viscosity of medium (dyne sec $cm^{-2}$).

The grading methods 700 and 900 in some embodiments also are performed from front to back of a graphite X-Ray target 106 in order to provide the desired properties in an axial direction.

CONCLUSION

A composite X-Ray target is described. Although specific embodiments are illustrated and described herein, it will be appreciated by those of ordinary skill in the art that any arrangement which is calculated to achieve the same purpose may be substituted for the specific embodiments shown. This application is intended to cover any adaptations or variations. For example, although described in X-Ray terms, one of ordinary skill in the art will appreciate that implementations can be made for other X-Ray targets that provide the required function.

In particular, one of skill in the art will readily appreciate that the names of the methods and apparatus are not intended to limit embodiments. Furthermore, additional methods and apparatus can be added to the components, functions can be rearranged among the components, and new components to correspond to future enhancements and physical devices used in embodiments can be introduced without departing from the scope of embodiments. One of skill in the art will readily recognize that embodiments are applicable to future X-Ray targets, different graphite materials, and new X-Ray anodes.

The terminology used in this application is meant to include all environments and alternate technologies which provide the same functionality as described herein.

We claim:

1. An X-ray target comprising:

an X-ray target cap having an inner diameter and an outer diameter; and a composite graphite material operably coupled to the X-ray target cap, wherein the composite graphite material further comprises:

a first region located in the vicinity of the outer diameter; and a second region located in the vicinity of the inner diameter having higher strength properties and lower heat conductive properties than the first region.

2. The X-ray target of claim 1 further comprising:

gradual variation in the properties between the first region and the second region without any clear dividing point.

3. The X-ray target of claim 1, wherein the first region is formed from high thermal conductivity graphite precursors.

4. The X-ray target of claim 1, wherein the X-Ray target cap is manufactured from a refractory metal.

5. The X-ray target of claim 4, wherein the refractory metal further comprises:

molybdenum.

6. The X-ray target of claim 4, wherein the refractory metal further comprises:

molybdenum alloys.

7. The X-ray target of claim 4, wherein the refractory metal further comrises:

tungsten.

8. The X-ray target of claim 4, wherein the refractory metal further comprises:

tungsten alloys.

9. The X-ray target of claim 1 wherein the X-ray target cap further comprises:

a focal track located on the outer diameter.

10. The X-ray target of claim 1, wherein the first region is brazed to the X-ray target cap.

11. The X-ray target of claim 1, wherein the second region is brazed to the X-ray target cap.

12. The X-ray target of claim 1 wherein the first region has a thermal conductivity of 120 watts/meter k and the second region has a thermal conductivity of 70 watts/meter k.

13. An X-ray target comprising:

an X-ray target cap; and a composite graphite material operably coupled to the X-ray target cap, wherein the composite graphite material further comprises:

a first region; and a second region having higher strength properties and lower heat conductive properties than the first region, wherein the first region is positioned further away from an inner diameter of the X-ray target cap than the second region.

14. The X-ray target of claim 13, further comprising:

a focal track located on an outer diameter of the X-ray target cap.

15. The X-ray target of claim 14, wherein the variation further comprises:

a variation in the properties between the first region and the second region along a radial direction.

16. An anode assembly of a computed tomography imaging system, the anode assembly comprising:

an Xray target cap having an inner diameter and an outer diameter, and a focal track located on the outer diameter; and a composite graphite X-ray target operably coupled to the X-ray target cap comprising:

a first region that is located in the vicinity of the inner diameter, and a second region having higher heat conductive properties and lower strength properties than the first region and second region being located in the vicinity of the outer diameter.

17. The anode assembly of claim 16, wherein the properties have a gradual variation without any clear boundary between the regions.

18. The anode assembly of claim 16, wherein the properties have a distinct boundary.

19. A method to grade a composite graphite X-ray target, the method comprising:

creating a structure of thermal conductive graphite precursors that defines an outer perimeter of the X-ray target;

placing a first layer of graphite precursors inside the structure;

creating a second layer having lower thermal conductivity and higher strength graphite precursors than the first layer;

pressing the composite graphite for a X-ray target;

impregnating the composite graphite;

graphitizing the composite graphite X-ray target; and purifying the composite graphite X-ray target.

20. The method of claim 19, wherein placing layers of graphite precursors inside the structure further comprises:

placing high thermal conductivity graphite precursors; and placing high strength graphite material.

* * * * *